US010653906B2

(12) United States Patent
Ringer et al.

(10) Patent No.: US 10,653,906 B2
(45) **Date of Patent: *May 19, 2020**

(54) INTEGRATED FLUID CONTROL VALVE AND VALVE ACTUATOR ASSEMBLY

(71) Applicant: Tyco Fire Products LP, Lansdale, PA (US)

(72) Inventors: Yoram Ringer, Providence, RI (US); Su Yang, Providence, RI (US)

(73) Assignee: Tyco Fire Products LP, Lansdale, PA (US)

( * ) Notice: Subject to any disclaimer, the term of this patent is extended or adjusted under 35 U.S.C. 154(b) by 420 days.

This patent is subject to a terminal disclaimer.

(21) Appl. No.: 15/033,044

(22) PCT Filed: Nov. 4, 2014

(86) PCT No.: PCT/US2014/063925

§ 371 (c)(1),
(2) Date: Apr. 28, 2016

(87) PCT Pub. No.: WO2015/066710

PCT Pub. Date: May 7, 2015

(65) Prior Publication Data

US 2016/0279454 A1 Sep. 29, 2016

Related U.S. Application Data

(60) Provisional application No. 61/899,855, filed on Nov. 4, 2013, provisional application No. 61/962,427, filed on Nov. 7, 2013.

(51) Int. Cl.
*A62C 35/68* (2006.01)
*A62C 35/64* (2006.01)

(52) U.S. Cl.
CPC ..... *A62C 35/68* (2013.01); *A62C 35/645* (2013.01)

(58) Field of Classification Search
CPC .... F16K 31/402; F16K 31/145; F16K 31/365; A62C 37/46; A62C 35/68; A62C 35/645;
(Continued)

(56) References Cited

U.S. PATENT DOCUMENTS 1,849,764 A * 3/1932 Loepsinger ..... A62C 35/645 169/20
3,220,483 A 11/1965 Hoevenaar
(Continued)

FOREIGN PATENT DOCUMENTS

CN 1213324 A 4/1999
CN 1424929 A 6/2003
(Continued)

OTHER PUBLICATIONS

International Search Report and Written Opinion, PCT2014/063925, dated Aug. 5, 2015, 19 pages.
(Continued)

*Primary Examiner* — Chee-Chong Lee
*Assistant Examiner* — Christopher R Dandridge
(74) *Attorney, Agent, or Firm* — Foley & Lardner LLP

(57) ABSTRACT

Systems and methods of an integrated fluid control valve and valve actuator assembly are provided. The assembly includes a pressure operated fluid control valve for controlling the flow of liquid from a liquid supply piping system into a sprinkler piping system of a fire protection system when transitioning the fire protection system from a standby state to an actuated state. The control valve defines a valve chamber for holding a pressurized fluid to prevent the flow of fluid through the control valve. A valve actuator is coupled to the fluid control valve housing for setting of the fluid control valve in an unactuated ready state and for operating the fluid control valve automatically and/or manually. Automatic control devices can be placed in fluid
(Continued)

communication with the valve actuator to maintain and control operation of the valve actuator for controlled operation of the fluid control valve.

17 Claims, 10 Drawing Sheets

(58) Field of Classification Search
CPC ..... A62C 35/60; A62C 35/605; A62C 35/62; Y10T 137/0379
USPC ..... 239/104, 120, 121; 169/16–22
See application file for complete search history.

(56) References Cited

U.S. PATENT DOCUMENTS

| | | | | |
|---|---|---|---|---|
| 4,226,259 | A * | 10/1980 | Szekely | F16K 31/365 137/269 |
| 5,632,465 | A * | 5/1997 | Cordua | F16K 7/126 251/30.02 |
| 8,307,906 | B2 * | 11/2012 | Reilly | A62C 35/64 169/16 |
| 8,616,234 | B2 * | 12/2013 | Ringer | F16K 7/126 137/489.5 |
| 9,492,696 | B2 * | 11/2016 | Ringer | A62C 35/62 |
| 2010/0071776 | A1 | 3/2010 | Ringer et al. | |

FOREIGN PATENT DOCUMENTS

| | | | |
|---|---|---|---|
| CN | 101080592 | A | 11/2007 |
| RU | 2116810 | | 8/1998 |
| RU | 2401148 | | 10/2010 |
| WO | WO2008/051871 | | 5/2008 |
| WO | WO2012/112808 | | 8/2012 |
| WO | WO-2013/058819 | A1 | 4/2013 |

OTHER PUBLICATIONS

IFW, U.S. Appl. No. 61/899,855, filed Nov. 4, 2013, Apr. 27, 2016, 232 pages.
Office Action on CN Application 201480070067.0, dated Oct. 9, 2018, 18 pages with translation.
Office Action on RU Application No. 2016122128, dated Aug. 1, 2018, 10 pages with translation.
Tyco Fire Products LP, "Model DV-5 Deluge Valve Diaphragm Style 1-1.2 through 8 Inch (DN40 through DN 200) Deluge Systems—Electric Pilot Actuation.", Mar. 2004.
Tyco Fire Products LP, "Model DV-5 Deluge Valve Diaphragm Style 1-1.2 through 8 Inch (DN40 through DN 200) Deluge Systems—Dry Pilot Actuation.", Mar. 2004.
Tyco Fire Products LP, "Model DV-5 Deluge Valve Diaphragm Style 1-1.2 through 8 Inch (DN40 through DN 200) Deluge Systems—Wet Pilot Actuation.", Mar. 2004.

* cited by examiner

INTEGRATED FLUID CONTROL VALVE AND VALVE ACTUATOR ASSEMBLY

PRIORITY CLAIM

This application is an international application claiming the benefit of priority to U.S. Provisional Application No. 61/962,427, filed on Nov. 7, 2013, and U.S. Provisional Application No. 61/899,855, filed on Nov. 4, 2013, each of which application is incorporated herein by reference in its entirety.

TECHNICAL FIELD

This invention relates generally to a differential fluid control valve, and more specifically relates to a valve actuator for actuating a fluid control valve of a fire protection system.

BACKGROUND ART

An automatic sprinkler system is one of the most widely used devices for fire protection. These systems have sprinklers that are activated once the ambient temperature in an environment, such as a room or a building, exceeds a predetermined value. Once activated, the sprinklers distribute fire-extinguishing fluid, preferably water, in the room or building. A fire sprinkler system, depending on its specified configuration, is considered effective if it controls or suppresses a fire.

The sprinkler system can be provided with a water supply (e.g., a reservoir or a municipal water supply). Such supply may be separate from that used by a fire department. Regardless of the type of supply, the sprinkler system is provided with a main that enters the building to supply a riser. Connected at the riser are valves, meters, and, preferably, an alarm to sound when the system activates. Downstream of the riser, a usually horizontally disposed array of pipes extends throughout the fire compartment in the building. Other risers may feed distribution networks to systems in adjacent fire compartments. The sprinkler system can be provided in various configurations. In a wet-pipe system, used for example, in buildings having heated spaces for piping branch lines, all the system pipes contain a fire-fighting liquid, such as, water for immediate release through any sprinkler that is activated. In a dry-pipe system, used for example, in unheated areas, areas exposed to freezing, or areas where water leakage or unintended water discharge is normally undesirable or unacceptable such as, for example a residential occupancy, the pipes, risers, and feed mains, branch lines and other distribution pipes of the fire protection system may contain a dry gas (air or nitrogen or mixtures thereof) under pressure when the system is in a stand-by or unactuated condition. A valve is used to separate the pipes that contain the water. When heat from a fire activates a sprinkler, the gas escapes from the branch lines and the dry-pipe valve trips or actuates; water enters branch lines; and firefighting begins as the sprinkler distributes the water.

One type of fluid control valve used to separate the gas filled pipes and liquid filled pipes is a diaphragm-type or diaphragm style valve, such as that shown in U.S. Pat. No. 8,616,234, entitled "Fluid Control Valve Systems and Methods," or as shown in Tyco Fire Products published Data Sheet, TFP 1315 entitled, "Model DV-5 Deluge Valve, Diaphragm Style, 1-1.2 through 8 Inch (DN40 through DN 200) Deluge Systems—Dry Pilot Actuation." (March 2004) (hereinafter "TFP1315"), Tyco Fire Products published Data Sheet, TFP 1310 entitled "Model DV-5 Deluge Valve, Diaphragm Style, 1-1.2 through 8 Inch (DN40 through DN 200) Deluge Systems—Wet Pilot Actuation." (March 2004) (hereinafter "TFP1310"), Tyco Fire Products published Data Sheet, TFP 1320 entitled "Model DV-5 Deluge Valve, Diaphragm Style, 1-1.2 through 8 Inch (DN40 through DN 200) Deluge Systems—Electric Pilot Actuation." (March 2004) (hereinafter "TFP1320"), each of which is incorporated by reference in their entireties. To control the flow of fluid between the inlet and the outlet and the respective wet and dry portions of the system, the control valve uses an internal diaphragm member having a sealed position and an open position to control the flow of fluid through the valve so as to respectively prevent and permit the flow of fluid from the wet portion of the system to the dry portion of the system. The position of the diaphragm is controlled by fluid pressure acting on the internal diaphragm member. The fluid pressure is controlled by various components arranged to respond to system conditions.

DISCLOSURE OF INVENTION

Systems and methods of a preferred integrated fluid control valve and valve actuator assembly are provided. The preferred integrated fluid control valve and valve actuator includes an assembly that allows for a valve and trim assembly that is standardized for multiple system configurations. In particular, this integrated assembly allows for the same fluid control valve and valve actuator assembly to be used for systems that utilize wet pilot actuation, dry pilot actuation, electric actuation, and pneumatic/electric actuation. In order to utilize the integrated fluid control valve and valve actuator for the various systems, various actuation components are added to the integrated assembly.

The preferred integrated fluid control valve and valve actuator provides for an assembly that includes a fluid control valve having an inlet and an outlet disposed along an axis for controlling the flow of liquid from a liquid supply piping system into a sprinkler piping system when transitioning the fire protection system from a stand-by state to an actuated state. The control valve includes a valve housing that includes a valve chamber for holding a pressurized fluid to prevent the flow of fluid through the control valve. The preferred assembly includes a valve actuator including an actuator housing proximate to, preferably coupled to and more preferably secured to the valve housing.

In a preferred embodiment of a valve actuator, the housing has an interior surface which defines an internal chamber with a central axis. The valve actuator further includes a first actuator seat disposed along the interior surface of the housing circumscribed about the central axis and a second actuator seat disposed along the interior surface disposed and circumscribed about the first actuator seat. The valve actuator further preferably includes a seal member having a sealed position engaged with the first actuator seat and the second actuator seat and an open position axially spaced from the first and second actuator seats. The preferred valve actuator further preferably includes a first port that is proximate the first actuator seat and in fluid communication with the internal chamber. As used herein, unless otherwise expressly provided, a "port" includes a spatial volume defined by a channel, conduit or other passageway that provides for fluid communication between two or more areas, chambers or regions about or within a device or assembly. "Fluid communication" or "communication" as used herein, unless otherwise expressly provided, the passage of a liquid or gas between two or more areas, chambers, or regions of a device or assembly.

The preferred assembly further includes a second port in communication with the internal chamber and a third port in communication with the internal chamber. The third port is preferably isolated from the first and second port when the sealing member is in the sealed position and in fluid communication with the first port and second port when the sealing member is in the open position. A fourth port of the preferred actuator is in communication with the first port and in communication with the internal chamber. The fourth port is preferably isolated from the third port when the sealing member is in the sealed position, and in fluid communication with the third port when the sealing member is in the open position.

The ports or portions thereof preferably define a direction of fluid communication or additionally or alternatively defines a direction or orientation in which the port or a portion thereof extends relative to line, point, axis, surface or other area of a device and/or assembly. To provide fluid communication, the preferred ports of the actuator and/or control valve assembly include, define and or integrate one or more connections. As used herein, "connection" is a portion and more preferably an end portion of a port, device or assembly to couple, secure, or join the port, device or assembly to another device, or assembly or ports, connections and/or chambers thereof. Preferred embodiments of a connection include known mechanical connections, such as for example include threaded connections, quick-connect connections, fitted connections, soldered connections or welded connections. In a preferred embodiment of the assembly, the first port of the actuator preferably includes a first connection located in a first direction toward the axis, and the second, third, and fourth connections are preferably located in a second direction transverse to the first direction. The first connection preferably secures the actuator to the fluid control valve housing. In the preferred embodiment, the second and third connections are located at an opposed location on the housing from the fourth connection.

The preferred assembly further provides an actuator housing that preferably includes an interior surface defining an internal chamber that controls the volume of pressurized fluid within the valve chamber of the control valve. The actuator further includes a housing having a first connection providing fluid communication between the valve chamber and the internal chamber. A second connection provides fluid communication with an automatic control device and a third connection provides fluid communication with a drain line. The fourth connection provides fluid communication with a fluid supply. The first connection is preferably located in a first direction toward the longitudinal axis of the fluid control valve and the second, third, and fourth connections are located in a second direction transverse to the first direction. The second and third connections are located at an opposed location on the housing from the fourth connection. A manual reset actuator is preferably aligned with the first connection. The fifth connection provides fluid communication with the pressure gauge and the sixth connection provides fluid communication with a manual release device connected to a drain line. In a preferred embodiment, the fifth and sixth connections are disposed along the control valve axis and are located in a third direction transverse to the first direction and the second direction. The second and third connections are located adjacent each other and are located in the first direction, and the third connection being located between the second connection and the housing.

The preferred assembly further includes a housing that supports a drip funnel and an end of the drain line and disposed in the drip funnel are the ends of the drain lines from the third connection and the manual release device. The control valve preferably includes a neutral chamber that is defined by a diaphragm. The assembly preferably includes an alarm system coupled to a connection.

The preferred assembly further includes a fluid control valve having an inlet and an outlet disposed along a valve axis for controlling the flow of liquid from a liquid supply piping system into a sprinkler piping system when transitioning the fire protection system from a stand-by state to an actuated state. The control valve includes a valve housing that includes a valve chamber for holding a pressurized fluid to prevent the flow of fluid through the control valve. The preferred assembly includes a valve actuator including an actuator housing secured to the valve housing.

In another embodiment, a method of operating a valve actuator is provided where the preferred valve actuator has a stand-by state defined by the sealing member engaged with a first valve seat and a second valve seat formed along an internal surface of a housing of the valve and an actuated state defined by the sealing member spaced from the first valve seat and the second valve seat. The method preferably includes establishing the stand-by state, which more particularly includes locating the sealing member against the valve seats. The preferred method further includes providing fluid pressure from a common port to a chamber on a first side of the sealing member and a port on the second side of the sealing member. The preferred method further preferably includes establishing a trip state, which particularly includes exposing the chamber to an actuated automatic control device and placing the port in fluid communication with the chamber. The method preferably further includes placing the port in fluid communication with the chamber and placing the chamber in fluid communication with a drain. The preferred method further includes providing from a common port, fluid pressure to a chamber on a first side of the sealing member and a port on the second side of the sealing member further includes providing a pressurized fluid to a chamber of a control valve. The method preferably further includes providing a pressurized fluid from a chamber of a control valve to the chamber of the valve actuator when the port is placed in fluid communication with the chamber. The pressurized fluid from a chamber of the control valve to the chamber of the valve actuator further includes providing the pressurized fluid to a drain at a rate greater than the common port provides pressurized fluid to the chamber.

The preferred assembly provides an actuator housing that preferably includes an interior surface defining an internal chamber that controls the volume of pressurized fluid within the valve chamber of the control valve. The actuator further includes a housing having a first connection providing fluid communication between the valve chamber and the internal chamber. A second connection provides fluid communication preferably with devices that could include an electric actuation device, a pneumatic actuation device or a combination of an electric actuation and pneumatic actuation device. The third connection provides fluid communication with a drain line, and the fourth connection provides fluid communication with a fluid supply. The first connection is located in a first direction toward the valve axis and the second, third, and fourth connections are located in a second direction transverse to the first direction. The second and third connections are located at an opposed location on the housing from the fourth connection.

One preferred embodiment of the invention provides a preferred actuator for actuation of a control valve. The preferred actuator includes a housing having an interior surface defining an internal chamber with a central axis. A first actuator seat is disposed along the interior surface of the housing preferably circumscribed about the central axis, and a second actuator seat is disposed along the interior surface preferably circumscribed about the first actuator seat. A seal member defines a preferred sealed position engaged with the first actuator seat and the second actuator seat. The seal member further defines an open position axially spaced from the first and second actuator seats. The preferred valve actuator further includes a first port proximate the first valve seat in communication with the internal chamber; a second port in communication with the internal chamber, a third port in communication with the internal chamber, and a fourth port in communication with the first port and in communication with the internal chamber. For the preferred actuator, the third port is isolated from the first and second port when the sealing member is in the sealed position; and when the sealing member is in the open position, the third port is in fluid communication with the first port and the second port. The fourth port is isolated from the third port when the sealing member is in the sealed position; and when the sealing member is in the open position, the fourth port is in fluid communication with the third port.

The preferred valve actuator alone or in the system may include one or more of the following features additionally or in the alternative. For example, one embodiment is at least one spring member is disposed between the interior surface of the housing and the seal member to bias the seal member toward the open position with the at least one spring member located between the first and second actuator seats. The at least one spring member comprises at least one coil spring having a first end engaged with a portion of the interior surface of the actuator that includes the first actuator seat and is preferably between the first and second actuator seats. The second end of the coil spring is preferably engaged with a portion of the seal member that faces the first actuator seat. In one embodiment, the at least one spring member defines a first length with the sealing member in the open position that is greater than a second length when the seal member is in the sealed position. Alternatively, the first length in the open position of the sealing member can be less than the second length when the sealing member is in the sealed position. In a preferred embodiment, each of the first and second actuator seats are preferably substantially circular, the first valve seat having a first diameter and a second valve seat having a second diameter, the first diameter being greater than the second diameter.

Preferably, the seal member is centered about the central axis in the open position and the closed position. Moreover, the seal member is preferably supported in the open position within the housing only by a frictional engagement with the at least one spring member such that seal member is not supported by any other valve structure. In one embodiment of the valve actuator the fourth port defines a passage with a first portion and a second portion. The first portion has a first inlet with a first cross-sectional area, the second portion has a second inlet with a second cross-sectional area less than the first cross-sectional area. The seal member, when in a sealed position with the first and second actuator seats, preferably defines an annular void, which is even more preferably in communication with the third or drain port of the preferred actuator. The seal member preferably comprises a cylindrical member or assembly, having a distal side opposed to the first and second valve seats and a proximal side opposite the distal side. The distal side of the seal member preferably includes a seal that engages the first actuator seat and the second actuator seat in the sealed position. Preferably, the first port is a valve chamber port, the second port is a pilot port and the third port defines a drain port. The actuator in another embodiment, preferably includes a plunger member to engage the sealing member to locate the sealing surface against the first actuator seat and gas valve seat.

In another embodiment, a method of operating an valve actuator is provided where the preferred valve actuator has a stand-by state defined by the sealing member engaged with first valve seat and a second valve seat formed along an internal surface of a housing of the valve and an actuated state defined by the sealing member spaced from the first valve seat and the second valve seat. The method preferably includes establishing the stand-by state, which more particularly includes locating the sealing member against the valve seats. The preferred method further includes providing fluid pressure from a common port to a chamber on a first side of the sealing member and a port on the second side of the sealing member. The preferred method further preferably includes establishing a trip state, which particularly includes exposing the chamber to an actuated automatic control device and placing the port in fluid communication with the chamber. The method preferably further includes placing the port in fluid communication with the chamber and placing the chamber in fluid communication with a drain. The preferred method further includes providing from a common port, fluid pressure to a chamber on a first side of the sealing member and a port on the second side of the sealing member further includes providing a pressurized fluid to a chamber of a control valve. The method preferably further includes providing a pressurized fluid from a chamber of a control valve to the chamber of the valve actuator when the port is placed in fluid communication with the chamber. The pressurized fluid from a chamber of the control valve to the chamber of the valve actuator further includes providing the pressurized fluid to a drain at a rate greater than the common port provides pressurized fluid to the chamber.

The preferred assembly provides an actuator housing that preferably includes an interior surface defining an internal chamber that controls the volume of pressurized fluid within the valve chamber of the control valve. The actuator further includes a housing having a first connection providing fluid communication between the valve chamber and the internal chamber. A second connection provides fluid communication preferably with devices that could include an electric actuation device, a pneumatic actuation device or a combination of an electric actuation and pneumatic actuation device. The third connection provides fluid communication with a drain line, and the fourth connection provides fluid communication with a fluid supply. The first connection is located in a first direction toward the valve axis and the second, third, and fourth connections are located in a second direction transverse to the first direction. The second and third connections are located at an opposed location on the housing from the fourth connection.

The preferred system valve actuator further includes a first port proximate the first actuator seat and coupled to the chamber of the control valve to provide fluid communication between the chamber of the control valve and the internal chamber of the actuator. A second port is preferably coupled to an automatic control device that monitors the status of the fire protection system, with a third port and fourth port in communication with the internal chamber. The third port is preferably isolated from the first and second port when the sealing member is in the sealed position. The third port is preferably in fluid communication with the first port and second port when the sealing member is in the open position. The fourth port is preferably isolated from the third port when the sealing member is in the sealed position. The fourth port is preferably in fluid communication with the third port when the sealing member is in the open position. The fourth port provides fluid to the chamber of the valve and the internal chamber of the valve actuator to maintain the sealing member in the sealed position and the chamber is filled with pressurized fluid. The automatic control device can be a wet pilot actuator, a dry pilot actuator, an electrical actuator, and combinations thereof and the sealing member is manually actuated to the sealed position. The preferred system valve actuator further includes a fifth and sixth port in communication with the internal chamber and the fifth port is coupled to a manual release valve and the sixth port is coupled to a pressure gauge. Preferably, the first port is a valve chamber port, the second port is a control port and the third port defines a drain port and is coupled to a drain.

Another preferred embodiment provides for a fire protection system having a stand-by state and an actuated state. The system preferably includes a liquid supply piping system for supplying a liquid under a liquid pressure; a sprinkler piping system being filled with a gas under a gas pressure in the stand-by state, and a fluid control valve for controlling the flow of liquid from the liquid supply piping system into the sprinkler piping system upon transition of the fire protection system from the stand-by state to the actuated state, the control valve including a chamber for holding a pressurized fluid to prevent the flow of fluid through the control valve. The system further preferably includes a valve actuator including a housing having an interior surface defining an internal chamber with a central axis. A first actuator seat is preferably disposed along the interior surface of the housing circumscribed about the central axis; and a second actuator seat is preferably disposed and circumscribed about the first actuator seat. A sealing member preferably defines a sealed position within the actuator with the sealing member engaged with the first actuator seat and the second actuator seat. The sealing member further defines an open position axially spaced from the first and second actuator seats.

A preferred embodiment of a fluid control valve is provided that includes a housing defining a central valve axis an inlet and an outlet disposed along a flow axis. the control valve housing defining a central valve axis perpendicular and intersecting the flow axis to define a first plane. The flow axis defines a second plane perpendicular to the first plane with the flow axis defining the intersection of the first and second plane. At least one port of the fluid control valve is disposed to one side of the second plane with the at least one port having a connection defining a central axis extending parallel to the second plane and perpendicular to the first plane. In one embodiment, the fluid control valve defines a valve chamber disposed to one side of the second plane opposite the at least one port.

BRIEF DESCRIPTIONS OF THE DRAWINGS

The accompanying drawings, which are incorporated herein and constitute part of this specification, illustrate exemplary embodiments of the invention, and, together with the description given above, serve to explain the features of the invention.

FIG. 1A a front perspective view of a first preferred embodiment of a fluid control valve and valve actuator assembly.

MODE(S) FOR CARRYING OUT THE INVENTION

Figure 1A:
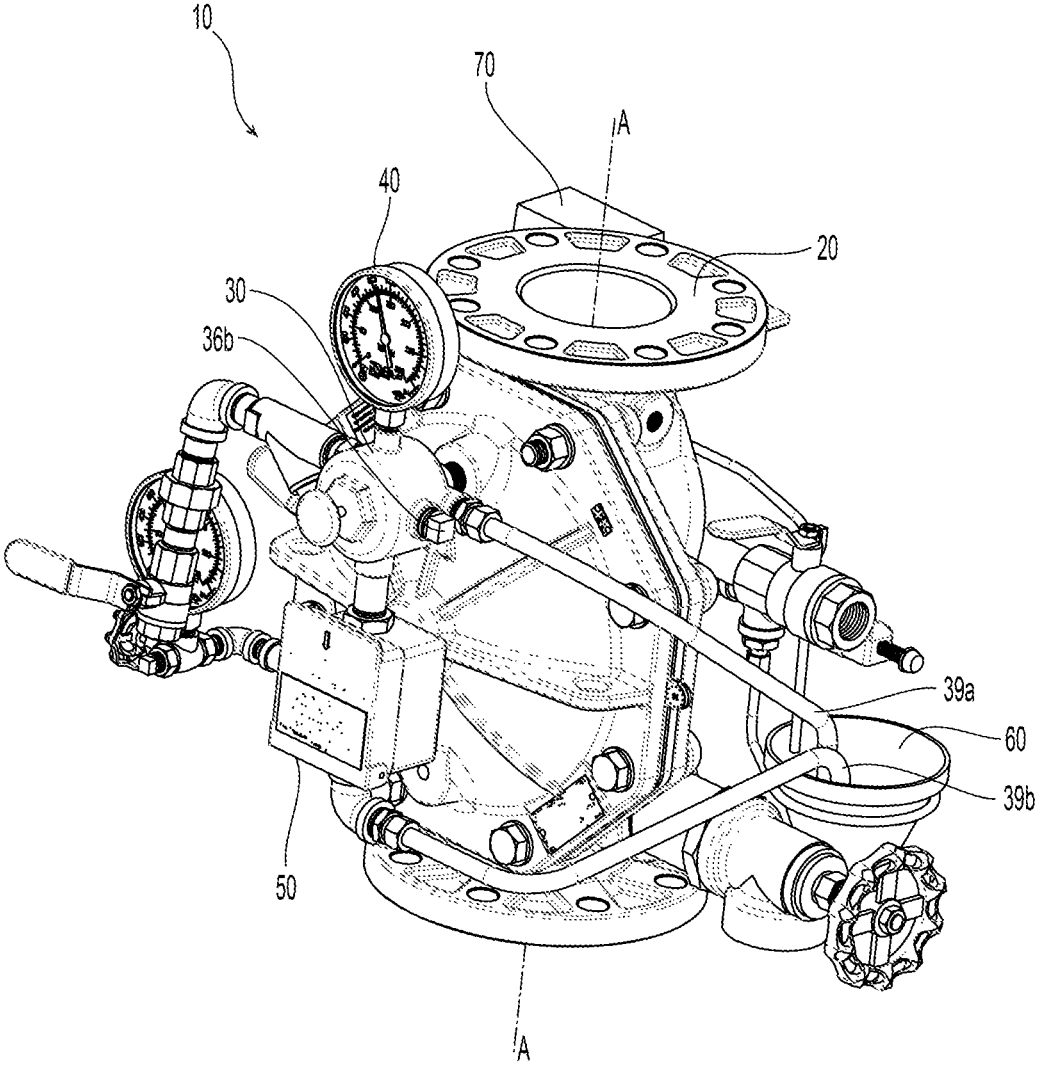
FIG. 1B is a rear perspective view of the fluid control valve and valve actuator assembly of FIG. 1A.
FIG. 1C is a side perspective view of the fluid control valve and valve actuator assembly of FIG. 1A.
Figure 1B:
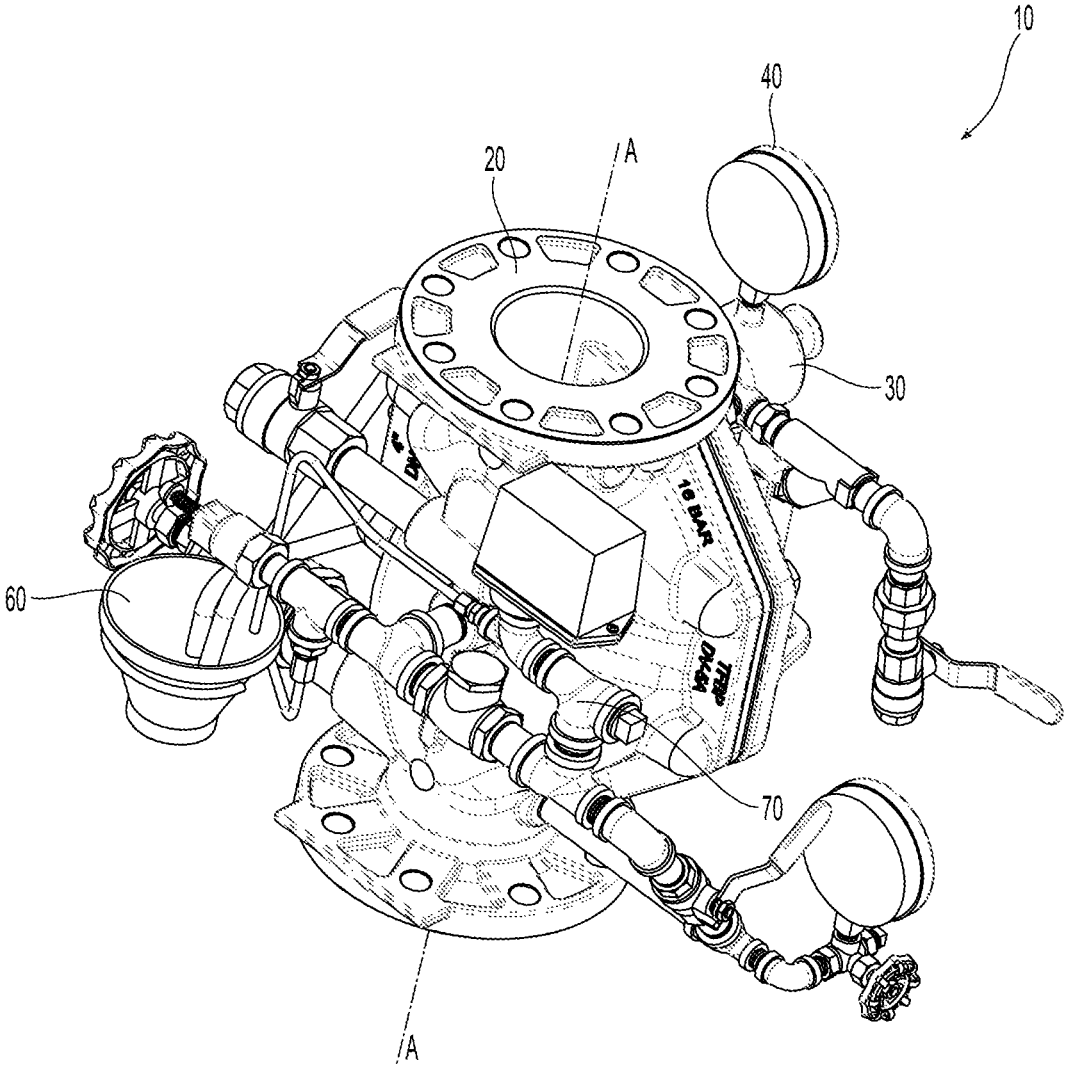
Figure 1C:
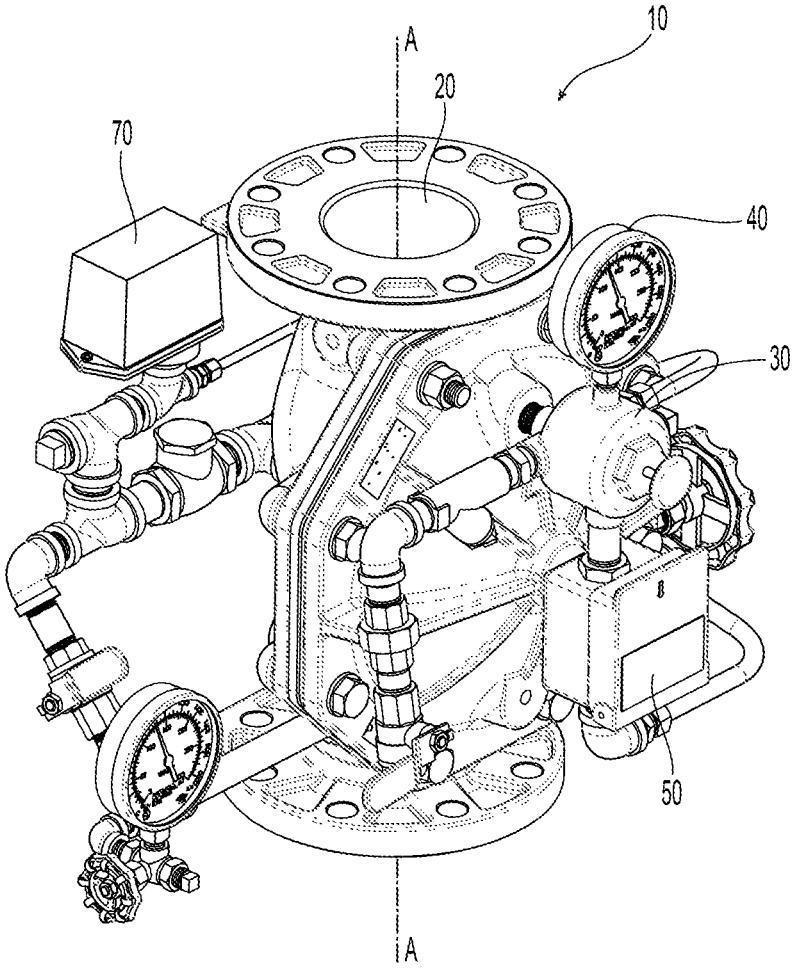
Figure 4B:
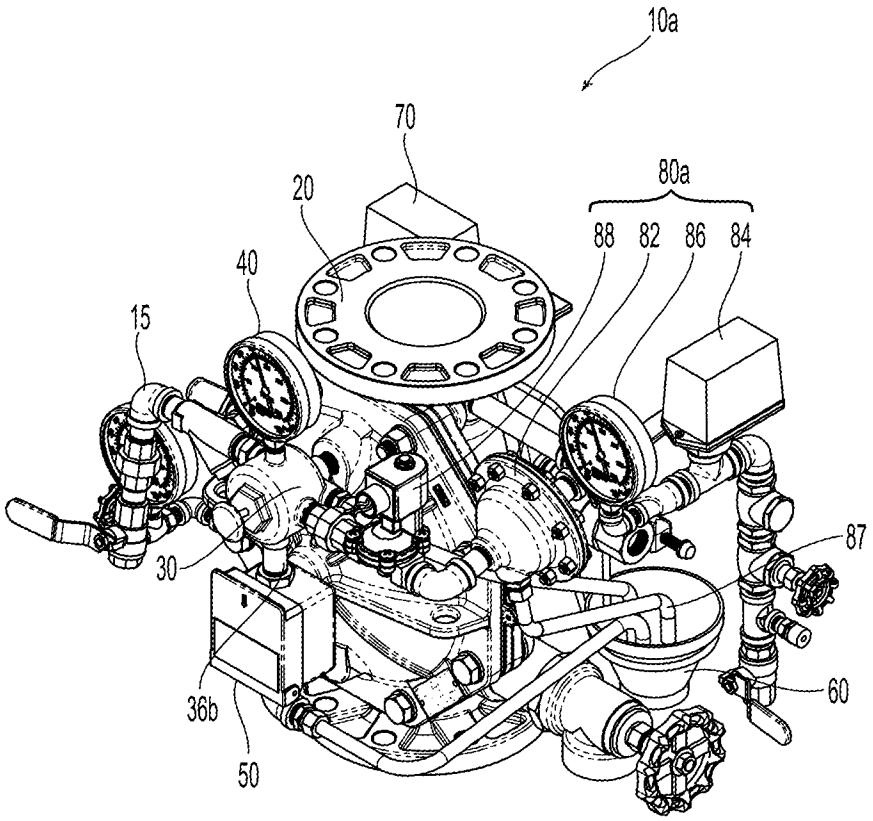
FIG. 4B is a perspective view of the automatic control device module of FIG. 4A in the assembly of FIG. 1A.
Figure 4A:
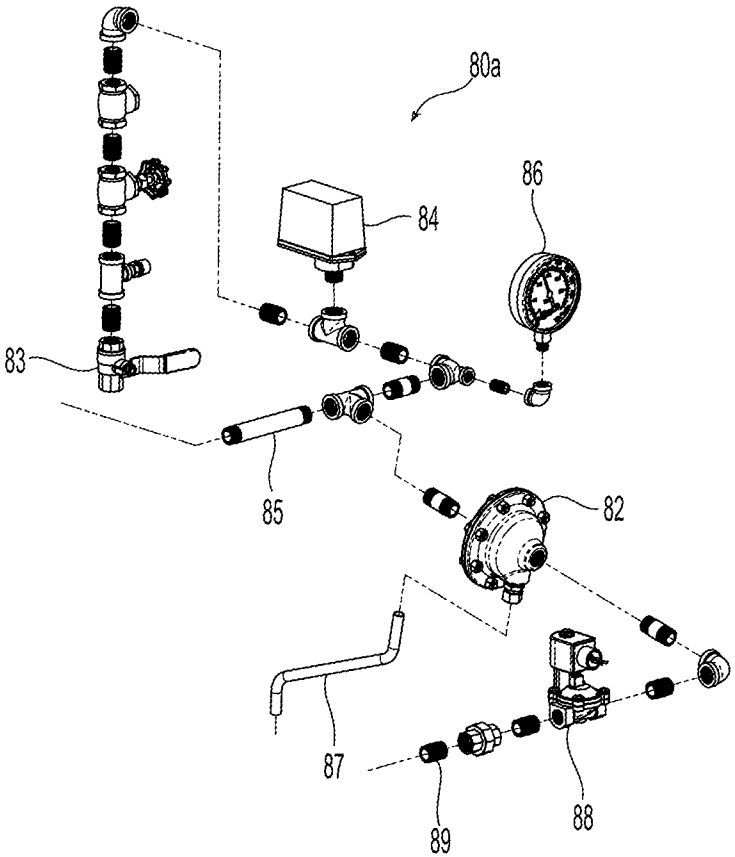
FIG. 4A is an exploded view of a preferred pneumatic and electric automatic control device module for use with the assembly of FIG. 1A.
Figure 5B:
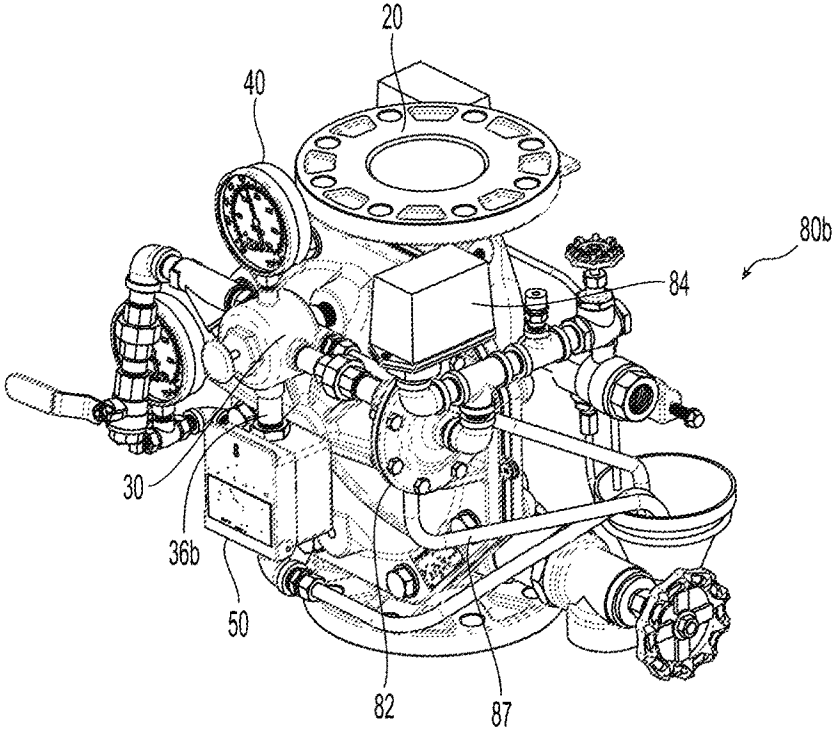
FIG. 5B is a perspective view of the automatic control device module of FIG. 5A in the assembly of FIG. 1A.
Figure 5A:
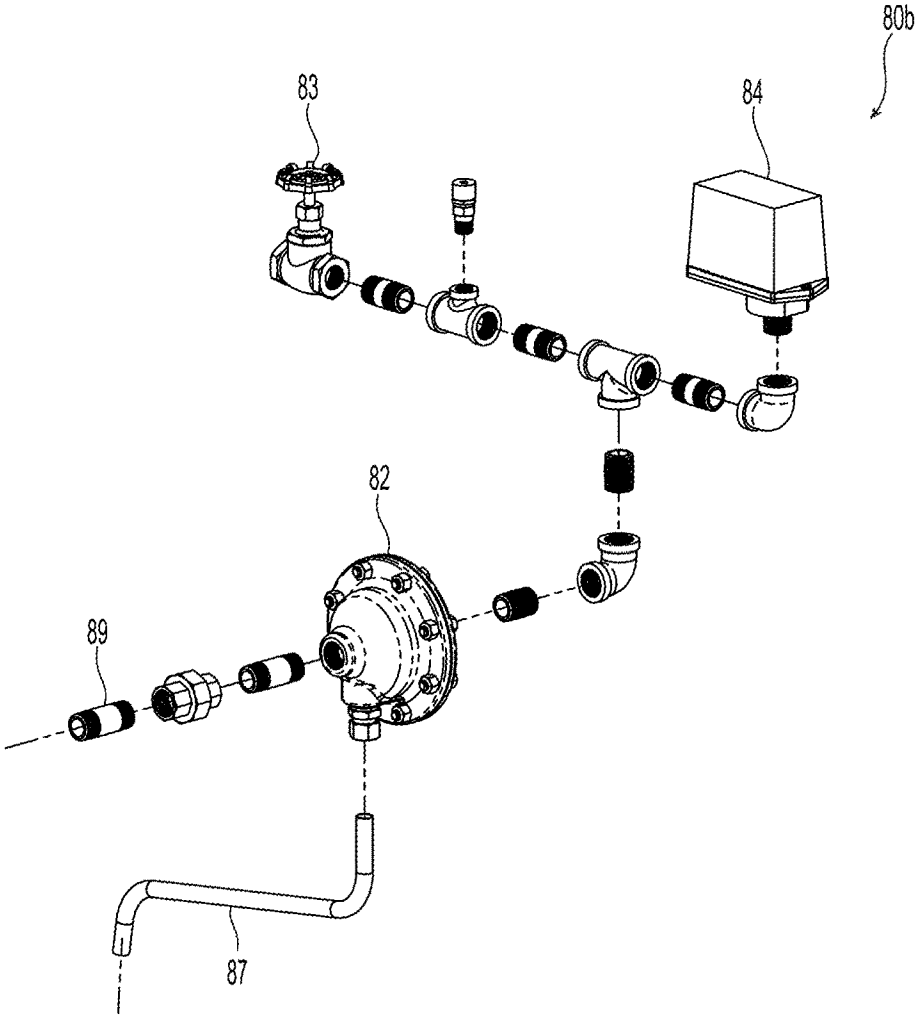
FIG. 5A is an exploded view of a preferred pneumatic control device module for use with the assembly of FIG. 1A.

FIGS. 1A-1C show a preferred embodiment of an integrated base fluid control valve and valve actuator assembly 10 with a preferred fluid control valve 20 and a valve actuator 30 for preferably controlling the flow of liquid in a fire protection system. The valve actuator 30 preferably provides for manual setting or resetting of the control valve 20 in an unactuated ready state and for preferably tripping the control valve 20 automatically and/or manually to an actuated or operated state. Either one of or both of the preferred fluid control valve and valve actuator 30 are preferably pressure operated. Accordingly, the base assembly 10 further preferably includes a pressurizing line 15, a pressure gauge 40, and manual release device 50 preferably coupled to the valve actuator 30. The preferred base assembly 10 further preferably includes a drip funnel or cup 60 for connecting fluid control components including the valve actuator 30 to a drain line. With reference to FIGS. 4A-4B, 5A-5B and 6A-6B are respective alternative embodiments of a preferred fluid control valve and valve actuator assembly 10*a*, 10*b*, 10*c* that includes the base fluid control valve and valve actuator assembly with a preferred a respective automatic control trim device or module 80*a*, 80*b*, 80*c* coupled to the valve actuator 30 for automatic operation of the assembly 10*a*, 10*b*, 10*c*. More particularly shown in FIGS. 4A-4B, is a preferred integrated fluid control valve and valve actuator assembly 10*a* with a preferably double interlock trim module 80*a*. Shown in FIGS. 5A-5B is a preferred integrated fluid control valve and valve actuator assembly 10*a* with a pneumatic trim control module 80*b*. Shown in FIGS. 5A-5B is a preferred integrated fluid control valve and valve actuator assembly 10*a* with an electric trim control module 80*c*.

Figure 2B:
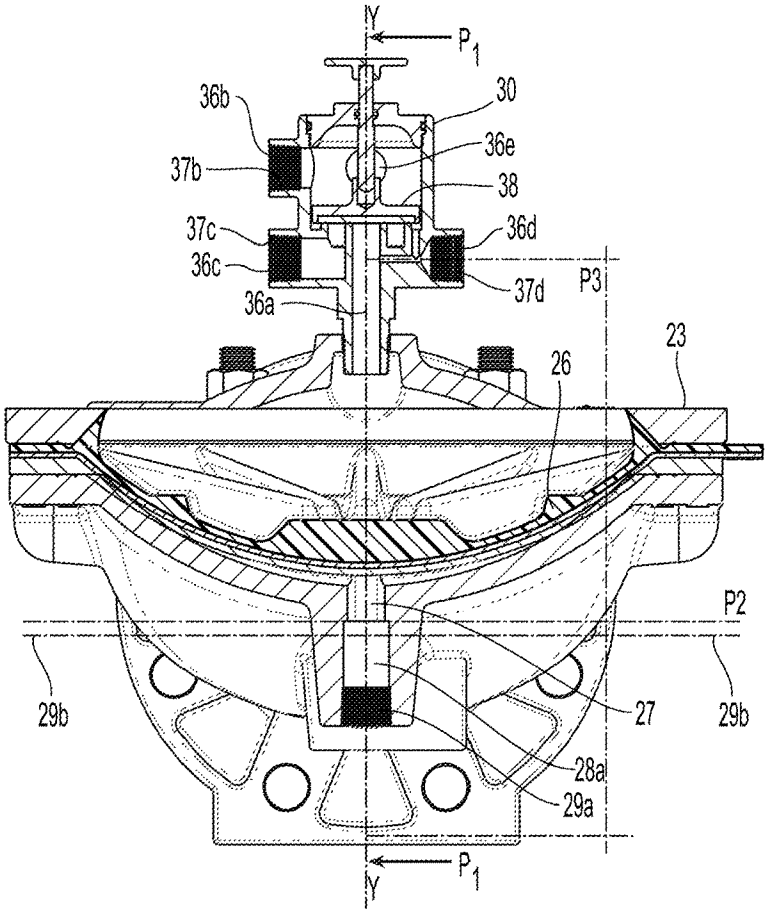
FIG. 2B is a cross-sectional view of the assembly of FIG. 2A along line IIB-IIB.
Figure 2A:
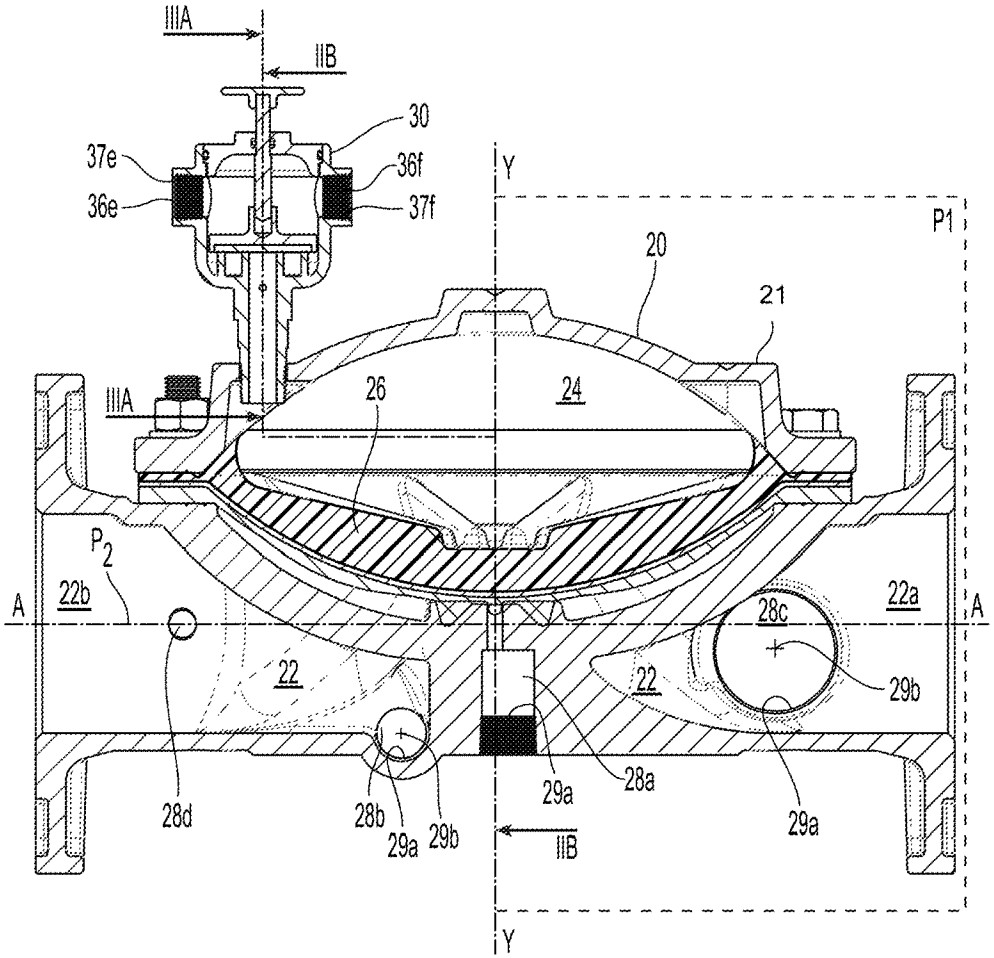
FIG. 2A is a cross-sectional view of a preferred fluid control valve and valve actuator used in the assembly of FIG. 1A.

Referring now to FIG. 2A-2B, show in cross-section is the integrated assembly 10 with a fluid control valve 20 for controlling the flow of liquid; and in particular, from a liquid supply piping system into a sprinkler piping system when transitioning the fire protection system from a stand-by state to an actuated state. Generally, a preferred fluid control valve 20 defines an internal fluid flow passageway or port 22 having an inlet 22*a* and an outlet 22*b*. The inlet and outlet 22*a*, 22*b* are preferably disposed along spaced apart and centered along a longitudinal axis A-A and more preferably along longitudinal flow axis A-A. Moreover, each of the inlet and outlet 22*a*, 22*b* can include an appropriate connection for respectively coupling to a liquid supply pipe and sprinkler piping main or riser. Exemplary connections include flange ends as shown, but the control valve 20 can include alternative connections. The internal flow port 22 is appropriately opened and closed for controlling the flow of liquid from the liquid supply piping system into the sprinkler piping system.

In a preferred embodiment of the base assembly 10, the fluid control valve is a pressure operated valve 20 to open and close its internal port 22. More preferably, the fluid control valve 20 is a diaphragm pressure operated fluid control valve. In a preferred embodiment of the fluid control valve 20, the fluid control valve 20 includes a valve housing 21 that defines a valve chamber 24 housing an internally disposed valve diaphragm 26. The valve diaphragm preferably has a sealed position and an open position to control the flow of fluid through the internal port 22. The position of the valve diaphragm 26 is preferably controlled by fluid pressure acting on the internal diaphragm member 26. To prevent the flow of fluid through the control valve 20, the valve chamber 24 preferably holds a pressurized fluid to maintain the valve diaphragm 26 in the seated position. More specifically, when the valve chamber 24 is filled with fluid, the valve diaphragm 26 is sealed against an internal surface of the valve housing 21.

In one preferred aspect of the housing 23 the housing 23 defines a second central valve axis Y-Y that extends perpendicular to and preferably intersects the first flow axis A-A to define a first plane P1. The flow axis A-A further preferably defines a second plane P2 perpendicular to the first plane P1 with the flow axis A-A defining the intersection of the first and second plane P1, P2. For preferred embodiments the fluid control valve 20, components and features of the valve 20 and/or assembly 10 and its components are directed, located, disposed and/or oriented relative to the first and second planes P1, P2. For example, a preferred embodiment of the fluid control valve 20 and its housing 23 includes one or more ports 28*a*, 28*b*, 28*c*, 28*d* located medially between or relative to the inlet 22*a* and outlet 22*b* for fluid communication with the preferably internal port 22. A medial ports 28 further preferably include a connection 29*a* defining a central axis 29*b*. In one preferred aspect, the preferred medial port 28 is disposed on one side of the second plane P2 with the central axis 29*b* extending parallel to the second plane P2 and perpendicular to the first plane P1. Moreover, in a preferred embodiment of the fluid control valve, the valve chamber is disposed to a first side of the second plane P2 opposite the medial port 28 disposed to the second side of the second plane P2.

For the embodiment of fluid control valve 20 shown in FIGS. 2A and 2B, the fluid control valve 20 preferably includes a first medially disposed port 28*a* which is preferably in fluid communication with a neutral chamber 27 that is in preferred fluid communication with the internal port 22 and flow path of the valve 20. The first medial port 28*a* preferably places the neutral chamber 27 in fluid communication with the system alarm 70 to detect and indicate flow through the valve 20. The system alarm 70 can include a fluid flow switch coupled to an alarm panel. The first medial port 28 and its preferred threaded connection 29*a* and central axis are shown in axial alignment or parallel with the central valve axis Y-Y. Alternatively and more preferably, the connection 29*a* of the neutral chamber port 28*a* is preferably oriented and located such that its central axis extends parallel to the second plane P2 and perpendicular to the first plane P1. Preferably disposed about the first medial port 28*a* and neutral chamber 27 are a first and second drain port 28*b* and 28*c* which are preferably oriented and located with their respective connections 29*b*, 29*c* parallel to the second plane P2 and perpendicular to the first plane P1 as shown. Accordingly, drain piping coupled to the drain ports 28*b*, 28*c* can be preferably oriented parallel to the second plane P2 and perpendicular to the first plane P1.

The preferred orientations of the medial ports and connections 28, 29 can present the preferred fluid control valve 20 and assembly 10 with a compact profile for mounting and installation. More specifically, the preferred orientation of the medial ports and connections 28, 29 can preferably orient and locate associated alarm system and drain piping to one side of and parallel to the second plane P2. For the preferred valve and actuator assemblies 10 described herein, this permits the drain and alarm piping to be mounted close and parallel to walls or other environmental structures. With the valve actuator 30 and its associated components preferably disposed on the opposite side of the second plane P2 from the alarm and drain piping, the installation render the valve actuator 30 and its associated components accessible to a user or operator for set up or maintenance. Moreover, the preferred embodiment disclosed herein utilizing the control valve 20 configuration allows for orientation of the system alarm 70 and its respective components at a minimal distance located from the longitudinal axis A-A of the control valve 20. The preferred distance from the longitudinal axis of the valve A-A, the center line of the system alarm 70 is preferably less than five inches.

The preferred embodiments of the integrated assembly 10 provide a valve actuator 30 proximate to, preferably coupled to, and even more preferably secured to the valve housing 21 of the fluid control valve 20, for example, as seen in FIGS. 2A and 2B. Moreover the actuator 30 is preferably coupled to the preferred fluid control valve 20 so as to be disposed to a side of the second plane P2 opposite, for example, the alarm port 28*a* or neutral chamber 27. As shown in FIGS. 2A and 2B, the actuator 30 has a housing 32 that includes an interior surface 32*a* defining an internal chamber 34 that controls the volume of pressurized fluid within the valve chamber 24 of the control valve 20 and the pressure acting on the preferred valve diaphragm 26 to control the flow of liquid through the control valve 20. Generally, the preferred valve actuator 30 includes a group of ports 36 including at least one port 36 that places the internal chamber 34 of the actuator 30 in fluid communication with the valve chamber 24 and one or more ports 36 in fluid communication with the internal chamber 34 and valve chamber 24 to increase or decrease the fluid pressure within the valve chamber 24 acting on the preferred diaphragm member to close or open the internal fluid port 22 of the fluid control valve 20.

In a preferred embodiment of the valve actuator 30, the actuator housing 32 preferably includes or defines six ports 36*a*, 36*b*, 36*c*, 36*d*, 36*e*, 36*f* in communication with the internal chamber 34. In addition, each of the ports preferably include a respective connection 37*a*, 37*b*, 37*c*, 37*d*, 37*e*, 37*f* for coupling the respective port and placing the internal chamber 34 in fluid communication with another area, region, chamber, or ports of the actuator or assembly 10. The connection can be embodied as threaded connection, a fitted connection, quick-connection, or any other mechanical connection for coupling the port. In one preferred aspect, the first preferred connection 37*a* allows port 36*a* to provides fluid communication between the valve chamber 24 of the fluid control valve 20 and the internal chamber 34 of the valve actuator 30. In another preferred aspect, the second connection 37*b* provides fluid communication through port 36*b* between the internal chamber 24 and the automatic control device or module 80, e.g. a device that preferably detects and/or indicates that a fire protection sprinkler system coupled to the assembly 10 has transitioned from a stand-by state to an actuated state. A third connection 37*c* provides fluid communication via third port 36*c* between the internal chamber 24 and a first drain line or port 39*a*, as seen for example in FIG. 1A. The fourth port 36*d* and its connection 37*d* preferably provides fluid communication to the internal chamber 34 from a fluid supply via fluid supply connection 36*fs*. A preferred fifth connection 37*e* provides fluid communication between the internal chamber 24 and the pressure gauge 40, seen for example in FIG. 1A, via the fourth port 36*e*, while a preferred sixth connection 37*f* provides fluid communication via fourth port 36*f* between the internal chamber 24 and the manual release device 50, seen for example in FIG. 1A, which is further preferably connected to a second drain line or port 39*b*. As shown herein, the ends of the first drain line 39*a* from the third connection 37*c* and the end of the second drain line 39*b* from the manual release device 50 are preferably disposed in the drip funnel 60. In the preferred embodiments, the control valve 20 via valve housing 21 supports a drip funnel 60. Moreover, the drip funnel can be supported relative to one or more reference planes or axes, such as for example, the drip funnel can be supported to one side of the second plane P2 opposite the valve actuator 30 or alternatively be supported on the same side of the second plane P2 as the valve actuator 30.

Figure 3A:
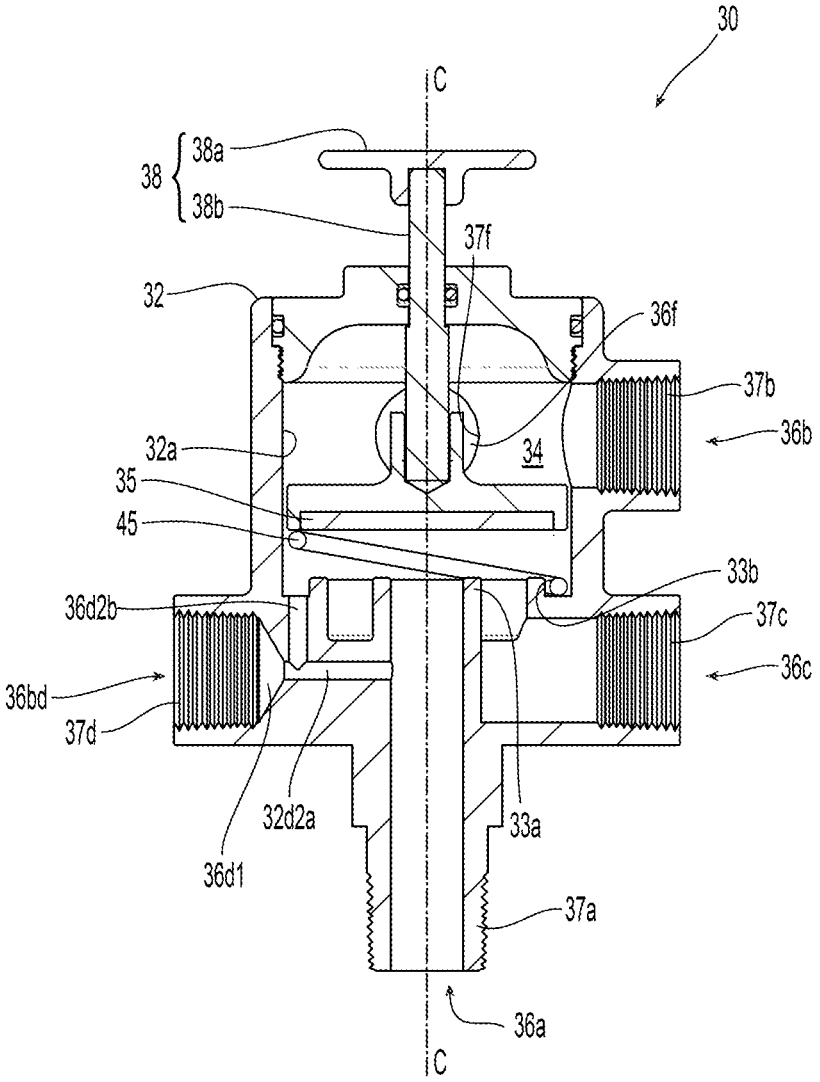
FIG. 3A is another cross-sectional view of the preferred valve actuator along line IIIA-IIIA in FIG. 2A.

Referring again to FIG. 3A, the preferred valve actuator housing 32 and internal chamber 34 preferably define a central axis C-C. A first actuator seat 33*a* is disposed along the interior surface 32*a* of the housing 32, preferably, circumscribed about the central axis C-C, and a second actuator seat 33*b* is disposed along the interior surface 32*a*, preferably, circumscribed about the first actuator seat 33*a*. A seal or sealing member 35 disposed within the internal chamber 34 defines a preferred sealed position engaged with the first actuator seat 33*a* and the second actuator seat 33*b*. The seal member 35 further defines an open position axially spaced from the first and second actuator seats 33*a*, 33*b*. In the preferred valve actuator 30, the first port 36*a* is preferably located proximate the first valve seat 33*a* in communication with the internal chamber 34. For the preferred actuator, the third port 36*c* is isolated from the first and second port 36*a*, 36*b* when the sealing member 35 is in the sealed position. When the sealing member 35 is in the open position, the third port 36*c* is in fluid communication with the first port 36*a* and the second port 36*b*. The fourth port 36*d* is isolated from the third port 36*c* when the sealing member 35 is in the sealed position; and when the sealing member 35 is in the open position, the fourth port 36*d* is in fluid communication with the third port 36*c*. In the preferred embodiment, the fourth port 36*d* defines a passage with a first portion 36*d*1 and a second portion 36*d*2. The first portion has a first inlet with a first cross-sectional area, the second portion has a second inlet with a second cross-sectional area less than the first cross-sectional area. The second portion 36*d*2 defines a first bore 36*d*2*a* between the first portion 36*d*1 and the first port 36*a*, and a second bore 36*d*2*b* between the first bore 36*d*2*a* and the internal chamber 34. The configuration of the first bore 36*d*2*a* and second bore 36*d*2*b* ensures that when the sealing member 35 is in the open position that fluid in the internal chamber 34 flows out of the third port 36*c* and to the drain 39*a* at a rate greater than fluid flows into internal chamber 34 from port 36*d*, which is connected to the system fluid supply. In a preferred embodiment, the first and second bores are ⅛ inch in diameter, and the third port 36*c* and fourth port 36*d* are ½ inch in diameter.

The preferred valve actuator 30 can utilize at least one spring member 45 disposed between the interior surface 32*a* of the housing 32 and the sealing member 35 to bias the sealing member 35 toward the open position and at least one spring member 45 is located between the first and second actuator seats 33*a*, 33*b*. The at least one spring member 45, is preferably, at least one coil spring having a first end engaged with a portion of the interior surface 32*a* of the actuator 30 preferably, between the first and second actuator seats 33*a*, 33*b*. The second end 45*b* of the coil spring is preferably engaged with a portion of the sealing member 35 that faces the first actuator seat 33*a*. In one embodiment, the at least one spring member 45 defines a first length with the sealing member in the open position that is greater than second length when the seal member is in the sealed position. Alternatively, the first length in the open position of the sealing member 45 can be less than the second length when the sealing member is in the sealed position. In a preferred embodiment, each of the first and second actuator seats 33*a*, 33*b* are preferably substantially circular, the first actuator seat 33*a* having a first diameter and a second actuator seat 33*b* having a second diameter, the first diameter being greater than the second diameter.

Preferably, the sealing member 35 is centered about the central axis C-C in the open position and the closed position. Moreover, the sealing member 35 is preferably supported in the open position within the housing only by a frictional engagement with the at least one spring member 45 such that sealing member 38*b* is not supported by any other valve structure. The sealing member 35, when in a sealed position with the first and second actuator seats, preferably defines an annular void, which is even more preferably in communication with the third port 36*c* of the preferred actuator, which is preferably connected to drain line 39*a*. The sealing member 35 preferably comprises a cylindrical member or assembly, having a first distal side opposed to the first and second valve seats 33*a*, 33*b* and a second proximal side opposite the distal side. The distal side of the seal member 35 preferably includes a seal that engages the first actuator seat and the second actuator seat in the sealed position.

Preferred embodiments of the control valve and valve actuator assembly 10 further include the manual reset actuator 38 to preferably reset assembly to its ready-state. The manual reset actuator 38 has a button 38*a* for operation by a user. The button 38*a* is operatively connected to the sealing member 35 by a locating structure or shaft 38*b*. The preferred orientation of the manual reset actuator 38 with respect to the valve housing 21 of the fluid control valve allows for the integrated assembly 10 to be a compact configuration and orientation of the components associated with each of the connections 37*a-f*. The manual reset actuator 38 is operated by displacing the button 38*a* toward the fluid control valve 20 so as to preferably locate the seal member 35 in or toward its sealed position. In particular, the manual reset actuator 38 is actuated toward the longitudinal axis A-A of the fluid control valve 20.

The ports 36 and/or their connections 37 are preferably oriented, directed and/or located in a preferred configuration relative to one or more reference axes, planes, surfaces and/or components of the assembly 10 to provide the arrangement of the integrated assembly. For example, referring to FIGS. 2A, 2B and 3A, the first connection 37*a* and preferably its axial center is preferably located in a first direction parallel to the preferred valve axis Y-Y toward the longitudinal axis A-A of the fluid control valve 20 and more preferably perpendicular to the second plane P2. The second connection 37*b*, third connection 37*c*, and the fourth connection 37*d* and their axial centers are preferably located in a second direction transverse to the first connection 37*a* and more particularly in a direction transverse to the longitudinal axis A-A and parallel to second plane P2. Alternatively, the second connection 37*b*, the third connection 37*c*, and the fourth connection 37*d* can be located in a direction of the longitudinal axis A-A of the control valve 20. The second connection 37*b* and a third connections 37*c* are preferably located at an opposed location on the actuator housing 32 from the fourth connection 37*d*. With this orientation of the first, second, third and fourth connections 37*a*, 37*b*, 37*c*, the manual reset actuator 38 is preferably axially aligned with the first connection 37*a*. Preferably, the fifth connection 37*e* and the sixth connection 37*f* are preferably axially spaced located from one another at opposed locations about the actuator housing 32 in a direction preferably parallel to longitudinal axis A-A of the control valve 20. The fifth connection 37*e* and the sixth connection 37*f* and preferably their axial centers are located in a third direction transverse to the respective directions of the first, second, third and fourth connections 37*a*, 37*b*, 37*c* and more preferably perpendicular to a third plane P3 which is perpendicular to each of the first and second planes P1, P2. Accordingly, the orientation of the center line of the first connection 37*a* is preferably at a right angle with the center line of each of the second to sixth connections 37*b*-37*f*, and the center line of the second connection 37*b* is at a right angle with the center lines of the fifth and sixth connections 37*e*, 37*f*, and the center lines of the second, third and fourth connections 37*b*, 37*c*, and 37*d* are substantially parallel. In a preferred embodiment, the center lines of the second, third and fourth connections 37*b*, 37*c*, and 37*d* are disposed in a common plane preferably perpendicular to the first and second planes P1, P2 and parallel to the third plane P3, and the center lines of the fifth and sixth connections are disposed in another common plane parallel to first plane P1 and preferably perpendicular to second and third planes P2, P3. It should be understood that, although in the preferred embodiments, the orientation of the connections 37*a-f* are configured such that their respective centerlines are at right angles, the central lines can be skewed as long as the respective connections are transverse with each other in a manner as described.

In the preferred embodiments, the second connection 37*b* and the third connection 37*c* are located adjacent each other on the actuator housing 32 and are located in the first direction parallel to the second plane P2 and preferably perpendicular to the first plane P1, and the third connection 37*c* is located between the second connection 37*b* and the actuator housing 32. The second and third connections 37*b* and 37*c* are preferably located next to each other on the actuator housing 32 so that they are located on the actuator housing 32 between the fifth and sixth connections 37*e*, 37*f*. In the preferred embodiment, the center lines of the second connection 37*b* and the third connection 37*c* are parallel; however, the second connection 37*b* and the third connection 37*c* can be disposed on the actuator housing so that the center lines of the second connection 37*b* and the third connection 37*c* are skewed. The distance between the second connection 37*b* and the third connection 37*c* can be set to an appropriate amount to allow for components to be secured to the connections.

The operation of the valve actuator 30 provides a stand-by state defined by the sealing member 35 engaged with first valve seat 33*a* and the second valve seat 33*b* and an actuated state defined by the sealing member 35 spaced from the first valve seat 33*a* and the second valve seat 33*b*. The method preferably includes establishing the stand-by state, which more particularly includes locating the sealing member 35 against the valve seats 33*a*, 33*b*. The preferred method further includes providing fluid pressure from a common port, preferably the fourth port 36*d*, to a chamber, preferably the internal chamber 34, on a first side of the sealing member 35 and a port, preferably the first port 36*a*, on the second side of the sealing member. The preferred method further, preferably, includes establishing a trip state of the valve actuator 30, which particularly includes exposing the internal chamber 34 to an actuated automatic control device, preferably, via second port 36*b*, and placing the first port 36*a* in fluid communication with the chamber. The method preferably further includes placing the first port 36*a* in fluid communication with the chamber 34, and placing the internal chamber 34 in fluid communication with a drain via the third port 36*c* valve. In one preferred aspect of operating the valve actuator 30, pressurized fluid is provided from the internal chamber 34 to a drain 39*a* at a greater rate than rate provided to the internal chamber from the common port 36*d*.

In FIG. 1A, the first embodiment of a preferred integrated fluid control valve and valve actuator assembly 10, the second port 36*b* is shown with a plug disposed there that can be removed for connection to piping of an automatic control device, such as, a wet pilot control arrangement or an embodiment of an automatic trim module 80. The automatic control device 80 preferably provides for an automatic trip response of the valve actuator 30 by preferably automatically draining fluid pressure from the internal chamber 34 in response to detection of a fire or other condition to so as to place the valve actuator in an actuated state. In one embodiment of the valve actuator assembly 10, the second port 36*b* of the valve actuator 30 can be coupled to a wet pilot sprinkler system (not show). The fluid pressure in the wet pilot sprinkler system would maintains the valve actuator in a ready-state. When the wet pilot sprinklers operate in response to a fire and fluid pressure in the wet pilot sprinkler system is released, the reduced fluid pressure permits the valve actuator 30 to trip and operate to its actuated state.

Shown in FIG. 4A is a preferred double interlock trim module 80*a*, which preferably includes a dry pilot actuator 82, a low pressure switch 84, a pressure gauge 86 and a preferably normally closed electronically operated solenoid valve 88 interconnected by appropriate piping and fittings for connection to the base valve and valve actuator assembly 10. In particular, the preferred double interlock trim module 80*a* can include a first connection 89 for coupling the electronically operated solenoid valve 88 to the second port 36*b*, a second connection 83 for coupling the low pressure switch to preferably a compressed gas supply (not shown), a third connection 85 for coupling to a dry sprinkler system piping and a drain line or port 87 for placing the dry pilot actuator in fluid communication with the drip funnel 60 and associated drain line. The electronic solenoid valve 88 is preferably configured for interconnection with an electronic detection system, such as for example, a heat or smoke detector and/or an associated releasing panel. FIG. 4B shows the preferred integrated fluid control valve and valve actuator assembly 10*a* with the preferred double interlock trim module 80*a* connected to the second actuator port 36*b*.

Shown in FIG. 5A is a preferred pneumatic trim module 80*b*, which preferably includes a dry pilot actuator 82, and a low pressure switch 84, interconnected by appropriate piping and fittings for connection to the base valve and valve actuator assembly 10. In particular, the preferred pneumatic trim module 80*b* can include a first connection 89 for coupling the dry pilot actuator 82 to the second port 36*b*, a second connection 83 for coupling the dry pilot actuator 82 and low pressure switch 84 to preferably a compressed gas supply (not shown), and either the dry sprinkler system and/or a dry pilot sprinkler system, a third connection 85 for coupling to a dry sprinkler system piping and a drain line or port 87 for placing the dry pilot actuator in fluid communication with the drip funnel 60 and associated drain line. FIG. 5B shows the preferred integrated fluid control valve and valve actuator assembly 10*b* with the preferred pneumatic trim module 80*b* connected to the second actuator port 36*b*.

Figure 6B:
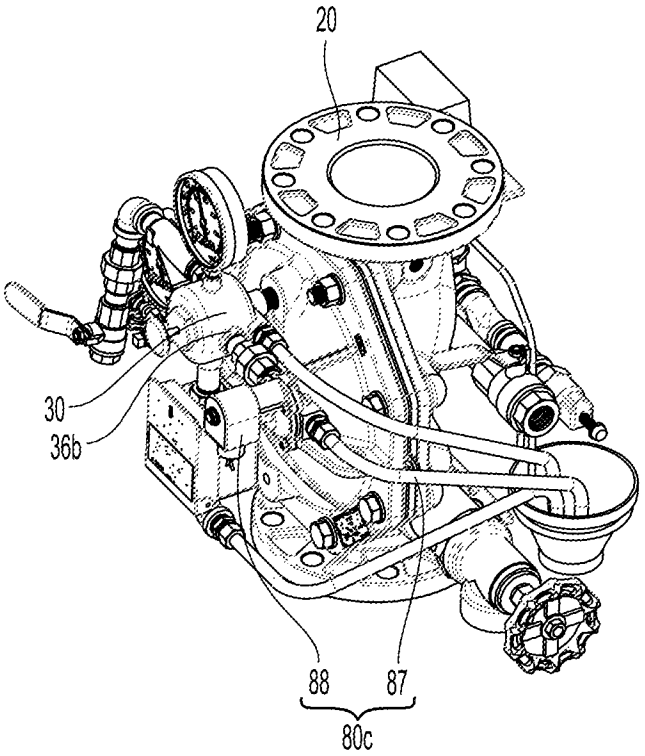
FIG. 6B is a perspective view of the automatic control device module of FIG. 6A in the assembly of FIG. 1A.
Figure 6A:
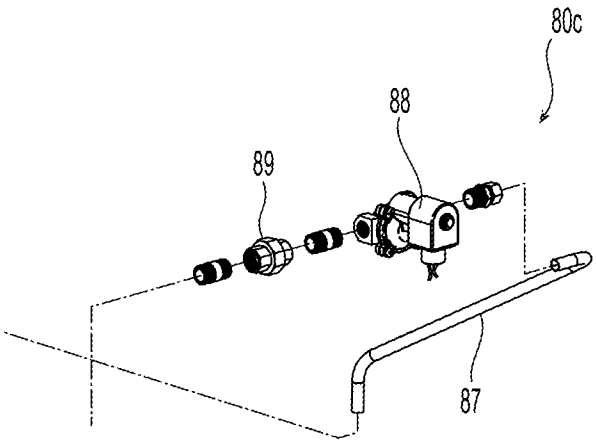
FIG. 6A is an exploded view of a preferred electric automatic control device module for use with the assembly of FIG. 1A.

Shown in FIG. 6A is a preferred electric trim module 80*c*, which preferably includes a preferably normally closed electronically operated solenoid valve 88 interconnected by appropriate piping and fittings for connection to the base valve and valve actuator assembly 10. In particular, the preferred electric trim module 80*c* can include a connection 89 for coupling the electronically operated solenoid valve 88 to the second port 36*b* and a drain line or port 87 for placing the solenoid valve 88 in fluid communication with the drip funnel 60 and associated drain line. The electronic solenoid valve 88 is preferably configured for interconnection with an electronic detection system, such as for example, a heat or smoke detector and/or an associated releasing panel. FIG. 6B shows the preferred integrated fluid control valve and valve actuator assembly 10*c* with the preferred electric trim module 80*c* connected to the second actuator port 36*b*.

Figure 7A:
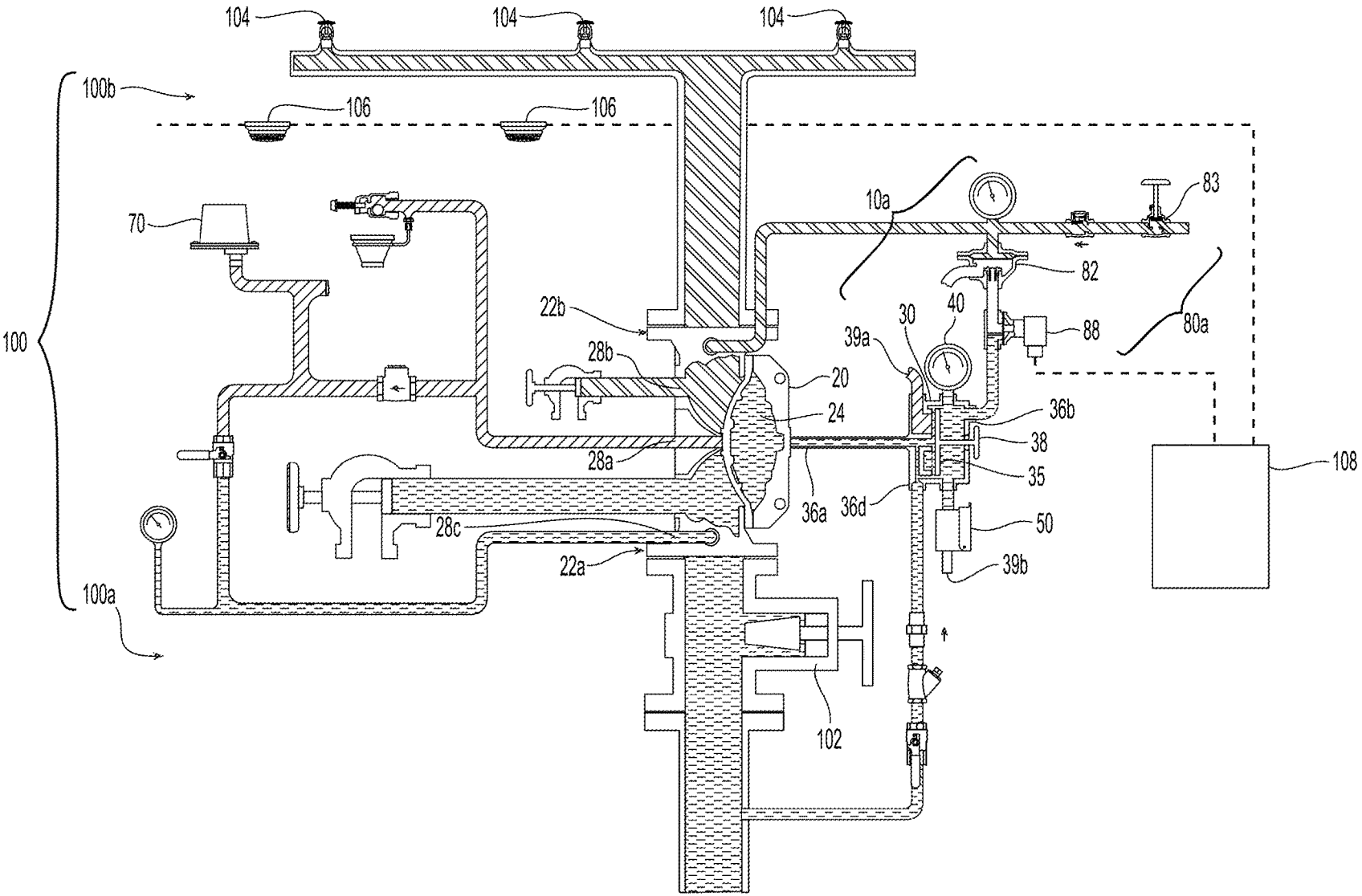
FIG. 7A is a schematic system diagram of a preferred fire protection system in an unactuated ready state with the assembly of FIG. 4A.
Figure 7B:
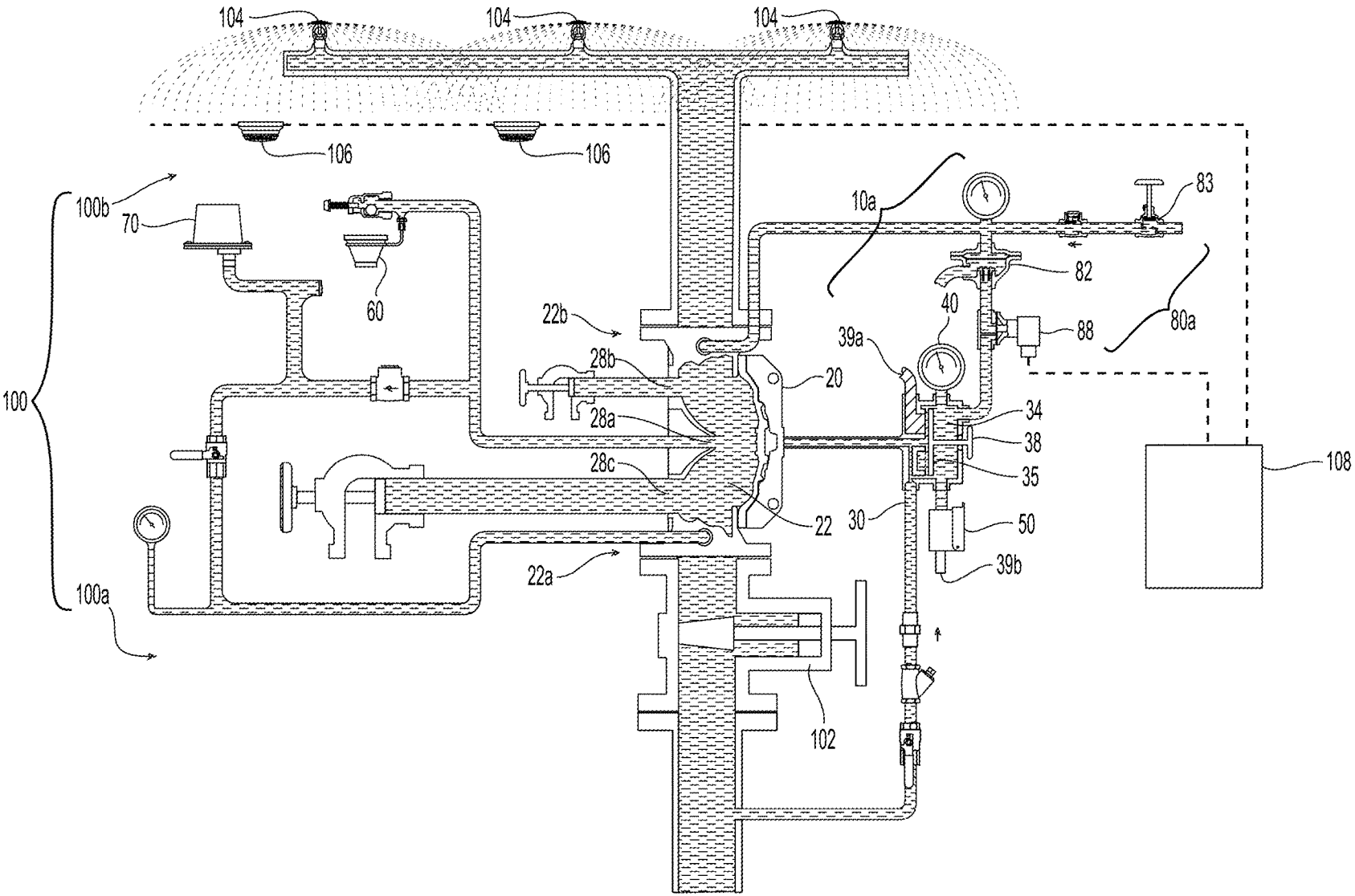
FIG. 7B is a schematic system diagram of the fire protection system of FIG. 7A in an actuated open state.

The preferred valve actuator 30 preferably provides for automatic and manual actuation of a control valve 20 and for resetting the control valve 20 to a stand-by state. Moreover, preferred operation of the valve actuator 30 sets, operates and controls the control valve 20 for placing a fire protection system in an unactuated ready-state and operating the fire protection system to address a fire. With reference to 7A-7B, shown are respective schematic views of the fire protection system 100 in an unactuated ready-state and an actuated operated state. As shown the fire protection system 100 includes a liquid supply piping system 100*a* for supplying a liquid, such as for example water to a sprinkler piping system 100*b* coupled together by a preferred embodiment of a preferably integrated fluid control valve and valve actuator assembly 10 described herein. The fire protection sprinkler piping system 100 shown in FIGS. 7A and 7B is an illustrative embodiment of a double-interlock preaction sprinkler system in which the sprinkler system employs automatic sprinklers 104 attached to a piping system 100*b* that contains air or other compressed gas under pressure with a supplemental detection system. The illustrated detection system includes one or more detectors 106 for detecting a fire, such as a smoke or heat detector 106 installed in the same area as the sprinklers 104. The detectors 106 are preferably interconnected with the electronic solenoid valve 88 of the preferred automatic control device 80*a* by the releasing panel 108 to operate the normally closed electronic solenoid valve 88 in response to a detection by the detectors 106. A second detection system includes a low air detection system which can detect an open or actuated sprinkler 104. The dry pilot actuator 82 of the preferred automatic control device 80*a* can act as the low air detector by operation upon detection of a low air threshold. For the double-interlock preaction system shown, the preferred valve actuator and valve assembly 10*a* operates from its ready or stand-by state to admit water to the sprinkler protection system 100*b* upon operation of both detectors 106, 82, the preferred automatic control device 80*a* and the preferred valve actuator 30.

Again, the preferred valve actuator 30 preferably provides for automatic and manual actuation of a control valve 20 and for resetting the control valve 20 to a stand-by state. More specifically, with reference to FIGS. 2A-2B, 3A in combination with FIGS. 7A-7B, a preferred method of operating the valve actuator 30 preferably includes establishing the stand-by state of the valve actuator 30 by locating the sealing member 35 against the preferred valve seats 33*a*, 33*b* and providing fluid pressure from the preferred common or fourth port 36*d* to the chamber 34 on a first side of the sealing member 35 and to a port on the second side of the sealing member. In one preferred embodiment of the method, the sprinkler system piping 100*b* is drained of water or otherwise dry with the preferably automatic fire protection sprinklers 104 in an unactuated state. A compressed gas, such as for example compressed air is preferably delivered through the preferred double interlock trim 80*a* via the connection 83. The trim 80*a* is preferably connected at least one of a medial port 28*b*, 28*d* of the fluid control valve for filling the sprinkler piping 100*b* with the compressed gas. The compressed gas pressure is permitted to close the dry pilot actuator 82 and the electronically operated solenoid valve 88 is returned to its normally closed position.

To reset the preferred valve and valve actuator assembly 10, water from the liquid supply piping system 100*a* is delivered to the first port 36*a* and the internal chamber 34 of the preferred actuator 30 and to the valve chamber 24 of the fluid control valve 20 via the common or fourth port 36*d*. To reset the valve diaphragm 26 of the preferred fluid control valve 20 in its sealed position, the preferred manual reset 38 is preferably depressed or operated to seat the seal member 35 in its sealed position against the first and second actuator seats 33*a*. 33*b*. The increase in the fluid pressure in the valve chamber 24 acts on the valve diaphragm 26 to its sealed position thereby closing the fluid port 22 and the fluid communication between the fluid system piping 100*a* and the sprinkler system piping 100*b* to permit the compressed air to come up to its stand-by pressure in the sprinkler piping system 100*b*. The preferred main water control valve 102 is opened to deliver water the inlet 22*a* of the fluid control valve and the main drain valve is closed and the liquid piping system 100*a* is brought up to its stand-by pressure to place the system 100 and the preferred valve and valve actuator assembly 10*a* in ready or stand-by-state.

With the preferred system in its ready-state, the system is ready to address a fire. For the preferred double-interlock system, the preferred heat or smoke detectors 106 are coupled to a releasing panel 108, which is coupled to the preferred electronic solenoid valve 88. In the presence of a sufficient level or heat or smoke, the normally open solenoid valve 88 opens to release the fluid pressure from the seal member 35 in the valve actuator 30 permitting it to move, trip or operate from its sealed position to its open position thereby placing the valve chamber 24 in fluid communication with the internal valve chamber 34. In the presence of a sufficient level of heat, one or more of the sprinklers 104 actuates to release compressed gas pressure from the sprinkler piping system 100*b*. The reduction in compressed gas pressure in the piping system 100*b* preferably trips or opens the dry pilot actuator and permits the fluid to discharge and drain from the internal chamber 34 at a greater rate than is supplied to the internal chamber 34 via the common port 36*d*. Accordingly, the seal member 35 of the actuator 30 moves to its open position and the fluid pressure in the valve chamber 24 is reduced as fluid is discharged from the valve chamber 24 and out a drain of the preferred trim 80*a* and the drain 39*a* from third port 36*c* of the actuator 30. With the reduced fluid pressure in the valve chamber 24, the valve diaphragm 26 moves from its sealed position to its open position to open the internal flow port 22 and place the liquid supply piping system 100*a* in fluid communication with the sprinkler piping system 100*b*. Water is permitted to fill the sprinkler piping system 100*b* and discharge from the actuated sprinklers 100*a* to address a fire. Water flowing through the open internal port 22 of the fluid control valve 20 preferably also discharges out of the medial port 28*a* and the neutral chamber 27 to sound the alarm system coupled thereto.

Control and operation of the preferred valve and actuator assembly 10 can be alternatively configured by changing the automatic control device coupled to the second port 36*b* of the valve actuator 30. In particular trim components can be reduced by coupling any one of the pneumatic or electric trim assembly 80*b*, 80*c* previously described. The pneumatic or electric trim assemblies 80*b*, 80*c* provide for a single interlock to operate or trip the valve actuator 30 and open the fluid control valve 20 in a manner as described. For the pneumatic trim module 80*b*, the dry pilot actuator detects low pressure in the pressurized sprinkler piping, indicative of a sprinkler 104 actuation, and in response operates to operate the valve actuator 30. The electric trim module 80*c*, upon receipt of a detection signal from the heat/smoke detectors 106 preferably via the releasing panel 108, opens from its normally closed position to operate the valve actuator 30.

The system 100 can be further altered by altering the sprinkler piping system to be either a sprinkler piping system in which the sprinklers 104 are always open. For such a system, the automatic control device coupled to the second port 36*b* of the valve actuator 30 can be anyone of a wet pilot or dry pilot sprinkler system. In such system, the actuation of the pilot sprinklers relieves fluid pressure on the seal member 35 of the valve actuator permitting it to trip and operate in a manner as previously described. In the case of the wet pilot system, the pilot system is preferably directly coupled to the second port 36*b* of the valve actuator 30. For a dry pilot actuator sprinkler system, the system is preferably coupled to the second port of the valve actuator 30 by the pneumatic trim module 80*b*. In another alternate embodiment in which the sprinklers 104 of the sprinkler piping system are always open, operation of the fluid control valve and valve actuator assembly 10*c* can be interlocked by preferably coupling the electronic trim module 80*c* to the second port 36*b* of the valve actuator 30, with an interconnection to appropriate fire heat/smoke detectors 106, to control the automatic operation of the valve actuator 30 in a manner as previously described.

While the present invention has been disclosed with reference to certain embodiments, numerous modifications, alterations, and changes to the described embodiments are possible without departing from the sphere and scope of the present invention, as defined in the appended claims. Accordingly, it is intended that the present invention not be limited to the described embodiments, but that it has the full scope defined by the language of the following claims, and equivalents thereof.

What is claimed is:

1. An assembly of a fluid control valve and valve actuator, comprising:

a pressure operated fluid control valve having an inlet and an outlet disposed along a flow axis for controlling a flow of liquid from a liquid supply piping system into a sprinkler piping system upon transition of a fire protection system from a stand-by state to an actuated state, the control valve having a valve housing defining a valve chamber for holding a pressurized fluid to prevent a flow of fluid through the control valve;

a valve actuator including an actuator housing having an interior surface defining an internal chamber with a central axis;

a first actuator seat disposed along the interior surface of the actuator housing circumscribed about the central axis;

a second actuator seat disposed along the interior surface disposed and circumscribed about the first actuator seat;

a cylindrical seal member having a first distal side opposed to the first actuator seat and the second actuator seat, the seal member defining a sealed position engaged with the first actuator seat and the second actuator seat, the seal member further defining an open position axially spaced from the first and second actuator seats;

a first port proximate the first actuator seat in communication with the internal chamber and the valve chamber of the control valve, the first port defined by the actuator housing and extending to an exterior surface of the actuator housing, the first port between the valve chamber and the seal member;

a second port in communication with the internal chamber for providing fluid communication with an automatic control device, the second port defined by the actuator housing, the first port between the second port and the valve chamber along a flow path from the second port to the valve chamber;

a third port for fluid communication with a drain line, the third port defined by the actuator housing, the third port being in communication with the internal chamber, the third port being isolated from the first and second ports when the sealing member is in the sealed position; the third port being in fluid communication with the first port and second ports when the sealing member is in the open position; and a fourth port for providing fluid communication with a fluid supply, the fourth port defined by the actuator housing, the fourth port being in communication with the first port and in communication with the internal chamber, the fourth port being isolated from the third port when the sealing member is in the sealed position, the fourth port being in fluid communication with the third port when the sealing member is in the open position.

2. An assembly of a fluid control valve and valve actuator of claim 1, wherein the valve actuator is secured to the fluid control valve.

3. An assembly of a fluid control valve and valve actuator of claim 1, wherein the first port includes a first connection located in a first direction toward the fluid control valve flow axis, the second port includes a second connection, the third port includes a third connection and the fourth port includes a fourth connection, the second, third, and fourth connections being located in a second direction transverse to the first direction, and the second and third connections being located at an opposed location on the actuator housing from the fourth connection.

4. An assembly of a fluid control valve and valve actuator of claim 1, wherein the valve actuator further comprises a manual reset actuator aligned with the first port.

5. An assembly of a fluid control valve and valve actuator of claim 1, wherein the valve actuator comprises a fifth port providing fluid communication with a pressure gauge.

6. An assembly of a fluid control valve and valve actuator of claim 5, wherein the valve actuator comprises a sixth port providing fluid communication with a manual release device connected to a drain line.

7. An assembly of a fluid control valve and valve actuator of claim 6, wherein the fifth port defines a fifth connection and the sixth port defines a sixth connection on the valve actuator, the first port defines a first connection located in a first direction parallel to a valve axis perpendicular to the flow axis of the valve, the second port defines a second connection located in a second direction transverse to the first direction, the third port defines a third connection located in the second direction, and the fifth and sixth connections are disposed along a control valve axis and are located in a third direction transverse to the first direction and the second direction.

8. An assembly of a fluid control valve and valve actuator of claim 1, wherein the second and third ports are located adjacent each other and located in the first direction, the third connection being located between the second port and the valve housing.

9. An assembly of a fluid control valve and valve actuator of claim 8, wherein the valve housing supports a drip funnel and an end of the drain line from the third port and an end of the drain line from the manual release device are disposed in the drip funnel.

10. An assembly of a fluid control valve and valve actuator of claim 1 wherein the pressure operated control valve includes a diaphragm that defines a neutral chamber.

11. An assembly of a fluid control valve and valve actuator of claim 10, wherein the pressure operated fluid control valve further comprises an alarm system coupled to an alarm port in fluid communication with the neutral chamber.

12. An assembly of a fluid control valve and valve actuator of claim 11, wherein the valve chamber defines a central valve chamber axis perpendicular to and intersecting the flow axis to define a plane, the port of the fluid control valve including a connection extending perpendicular to the plane.

13. An assembly of a fluid control valve and valve actuator of claim 1, wherein the valve chamber defines a central valve chamber axis perpendicular to and intersecting the flow axis to define a first plane, the flow axis defining a second plane perpendicular to the first plane, the flow axis defining an intersection of the first and second plane, the second plane dividing the assembly with the valve actuator disposed on a first side of the second plane and at least one port disposed on a second side of the second plane with the at least one port having a central axis parallel to the plane.

14. An assembly of a fluid control valve and valve actuator of claim 13, wherein the valve actuator comprises a fifth port providing fluid communication with a pressure gauge and a sixth port in fluid communication with the internal chamber of the valve actuator and a manual release device, the third port and the manual release device being in fluid communication with a drip funnel, the drip funnel being disposed on the second side of the second plane and the manual release and valve actuator being disposed on the first side of the second plane.

15. An assembly of a fluid control valve and valve actuator of claim 13, wherein the valve actuator comprises a fifth port providing fluid communication with a pressure gauge and a sixth port in fluid communication with the internal chamber of the valve actuator and a manual release device, the third port and the manual release device being in fluid communication with a drip funnel, the drip funnel, the manual release and the valve actuator being disposed on the same side of the second plane.

16. An assembly of a fluid control valve and valve actuator of claim 1, wherein the automatic control device includes any one of a wet pilot actuator, a dry pilot actuator, an electrical actuator, and combinations thereof.

17. A valve actuator comprising:

a housing having an interior surface defining an internal chamber with a central axis; a first actuator seat disposed along the interior surface of the housing circumscribed about the central axis;

a second actuator seat disposed along the interior surface disposed and circumscribed about the first actuator seat;

a cylindrical seal member having a first distal side opposed to the first actuator seat and the second actuator seat, the seal member defining a sealed position engaged with the first actuator seat and the second actuator seat, the seal member further defining an open position axially spaced from the first and second actuator seats;

a first port proximate the first actuator seat in communication with the internal chamber, the first port defined by the housing and extending to an exterior surface of the actuator housing, the first port between the valve chamber and the seal member;

a second port in communication with the internal chamber, the second port defined by the housing, the first actuator seat and second actuator seat between the first port and the second port along a flow path between the first port and the second port:

a third port in communication with the internal chamber, the third port being isolated from the first and second ports when the sealing member is in the sealed position;

the third port being in fluid communication with the first port and second port when the sealing member is in the open position, the third port defined by the housing; and a fourth port in communication with the first port and in communication with the internal chamber, the fourth port being isolated from the third port when the sealing member is in the sealed position, the fourth port being in fluid communication with the third port when the sealing member is in the open position, the fourth port defined by the housing.

* * * * *